US007296796B2

(12) United States Patent
Mackenzie

(10) Patent No.: US 7,296,796 B2
(45) Date of Patent: Nov. 20, 2007

(54) MULTIPLE DICE DEVICE

(76) Inventor: Simon Mackenzie, c/o E. Hanscom, 6994 El Camino Real #204, Carlsbad, CA (US) 92009

( * ) Notice: Subject to any disclaimer, the term of this patent is extended or adjusted under 35 U.S.C. 154(b) by 203 days.

(21) Appl. No.: 11/111,054

(22) Filed: Apr. 22, 2005

(65) Prior Publication Data

US 2006/0237903 A1 Oct. 26, 2006

(51) Int. Cl.
*A63F 9/04* (2006.01)

(52) U.S. Cl. ..... 273/146; 273/145 R; 273/145 C; 273/145 CA; D21/372; D21/373

(58) Field of Classification Search ..... 273/146, 273/145 C, 145 CA, 145 R; D21/372, 373
See application file for complete search history.

(56) References Cited

U.S. PATENT DOCUMENTS 1,593,907 A * 7/1926 Madan ..... 273/146
2,301,506 A * 11/1942 Bean ..... 273/145 C
2,526,123 A * 10/1950 Dawson ..... 273/145 C
2,528,029 A * 10/1950 Brown ..... 273/244.1
4,858,931 A 8/1989 McKechnie
5,918,881 A * 7/1999 Kirby ..... 273/146
6,331,145 B1 12/2001 Sity

OTHER PUBLICATIONS

"Double Dice", Koplow Games Catalog #11, front cover, website: www.koplowgame.com, received in the PTO on Nov. 22, 1999.*

* cited by examiner

*Primary Examiner*—Benjamin Layno
(74) *Attorney, Agent, or Firm*—Eric Hanscom; Todd Langford

(57) ABSTRACT

This invention is directed toward a multiple dice device and operational system utilizing one or more inner dice enclosed within a clear, outer die with independent rolling and chance capabilities. Within a clear outer die there is enclosed one or more inner dice which roll independently of the outer die, such that with a roll on the outer die by a user two or more chance results can be obtained. The outer and inner dice can be the standard 1-6 numerical dice, purely directional dice, dice with symbols on them or a combination of the various possible surfaces.

2 Claims, 2 Drawing Sheets

MULTIPLE DICE DEVICE

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

This invention is directed toward a multiple dice device and operational system utilizing one or more inner dice enclosed within a clear, outer die with independent rolling and chance capabilities. Within a clear outer die there is enclosed one or more inner dice which roll independently of the outer die, such that a roll on the outer die by a user results in two or more chance results being obtained. The outer and inner dice can be the standard 1-6 numerical dice, purely directional dice, dice with symbols on them or a combination of the various possible surfaces, so long as, at least, the outer die is clear.

Games involving dice are the oldest games of chance known to humans. Games of chance involving dice date back to at least 2,000 B.C. The earliest records we have of dice come from Egypt where dice were found in Egyptian tombs, although there are unverified records of primitive dice dating back to 6,000 B.C. It appears that dice were invented independently at several difference places throughout the world. According to Greek legends, throwing dice was considered to be more than merely luck; the roll was believed to be destined by the gods—in particular, Fortuna, the Roman Goddess and daughter of Zeus, who later became known as "Lady Luck"—and rolling dice was used to divide inheritances, choose rulers and as a method of prediction. Fortuna was believed to determine the outcome of a throw.

While the use of multiple dice has been a time-tested tradition and time-honored way of basing games of chance and strategy on which sides of two dice end up in a horizontal position on the top of each die, there has not prior to this invention been invented a means by which such results may be obtained by the role of a single unit. While this may seem to be a fairly trivial change to the centuries-old tradition of throwing two-dice, having one or more dice enclosed within an outer die has several decided advantages. First, if there is one inner die enclosed within an outer die, it is 50% less likely that a thrown die will knock over a playing piece in board games such as Monopoly and Parcheesi which have game pieces move about on a board and where the knocking of a game piece off its spot can result in confusion over where the piece was initially, diminishing the enjoyment of the game for all players. The odds become even more favorable for the user when the user is using the invention in games requiring more than two dice. Second, in games requiring two or more dice, a user of this invention will not have the situation where he or she loses one of the two dice, thereby preventing the game from being played until additional dice or die are obtained. Third, it decreases the chances that an unethical player will be able to favor a certain roll by picking up, arranging, and releasing the dice in a certain manner, as while he or she can pick up the multiple die, it will be considerably more difficult to get the inner die or dice to lie in the desired manner than it would be with two die, both of which can be touched and manipulated by the user.

The prior art has several examples of at least one attempt to resolve this problem. Electronic dice are well known in the prior art as a means by which cheating by manual manipulation and throwing of the dice can be eliminated and, at the same time, removing the problem of manually thrown dice knocking playing pieces off their initial positions. Electronic dice, however, are expensive, prone to electrical malfunctions, and do not usually show directions, as does the current invention.

Thus there has existed a long-felt need for a device which allows a user to obtain two or more results from the throw of a single dice. This invention solves this long-felt need by providing a multiple dice device and operational system utilizing one or more inner dice enclosed within a clear, outer die with independent rolling and chance capabilities. Within a clear outer die there is enclosed one or more inner dice which roll independently of the outer die, such that with a roll on the outer die by a user two or more chance results can be obtained. The outer and inner dice can be the standard 1-6 numerical dice, purely directional dice, dice with symbols on them or a combination of the various possible surfaces.

SUMMARY OF THE INVENTION

It is a principal object of the invention to provide a device by which a user of the invention can obtain multiple dice results while only rolling one die.

It is another object of the invention to decrease the likelihood of a user knocking over playing pieces on a board game through the use of dice.

It is an additional object of the invention to decrease the chance of an unscrupulous player cheating by picking up two or more dice, manipulating them in his or her hand, and then releasing them in a manner which favors the odds of certain results over others.

It is a further object of the invention that the game-playing experience be enhanced by a new and unique method of obtaining results in games of chance involving the use of two or more dice.

It is an additional object of this invention that a user of the invention be able to avoid the situation that results from a user of a traditional, two or more dice game, where if the user loses one of the die, the game cannot be played until additional dice or a die is found.

It is also an object of this invention that the inner die or dice be visible through a clear, outer die.

It is an additional object of the invention that the inner die can be made of red-colored plastic with directional arrows on it and the outer die can be made of clear plastic with the standard 1-6 faces.

It is a further object of the invention that the invention combine a numerical outer die and a directional inner die for role-playing games requiring a number for movement and a directional arrow which dictates the direction the player moves.

It is a final object of this invention to provide an inexpensive method of providing multiple die-rolling results through the use of one external, clear die and one or more internal die or dice.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION

Figure 1:
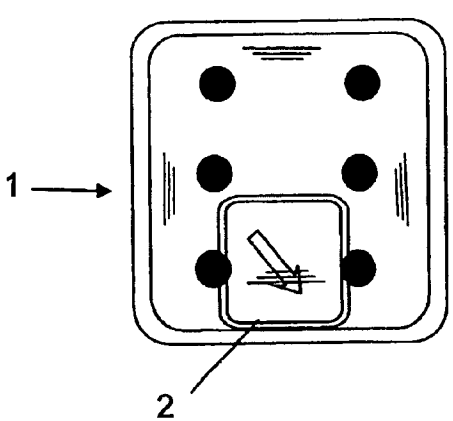
FIG. 1 is a front view of the invention showing the inner die enclosed in the outer die.

The invention, as illustrated by FIGS. 1-4, is simple in concept. Turning to FIG. 1, there is a clear outer die (1) which encloses an inner die (2). The outer die (1) is clear, so that the inner die (2) can be seen. When the user rolls the outer die, both die will tumble with both die showing results while the user only had to control and handle one die. Since the inner die (2) is not touched by the user, it is very difficult for an unethical user to arrange both the inner die and outer die before rolling such that a desired roll is more likely. Other advantages are apparent from this drawing, as the user has only one die to roll, and there is only one die that presents a danger of knocking over game pieces.

Figure 2:
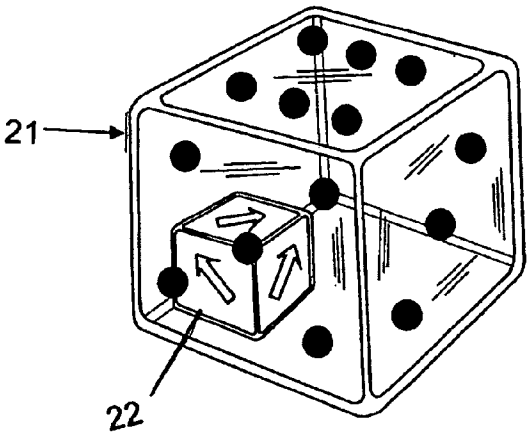
FIG. 2 is a right side, elevational view of the invention.

Turning to FIG. 2, this illustration shows another view of the invention, again showing the clear outer die (21) which encloses an inner die (22). The clear outer die in this iteration of the invention has the standard 1-6 dotted surface, while the inner die has directional arrows allowing the directional arrow to take a secondary role compared to the number represented by the dotted surface on the outer die, specifically designed for a role-playing game.

Figure 3:
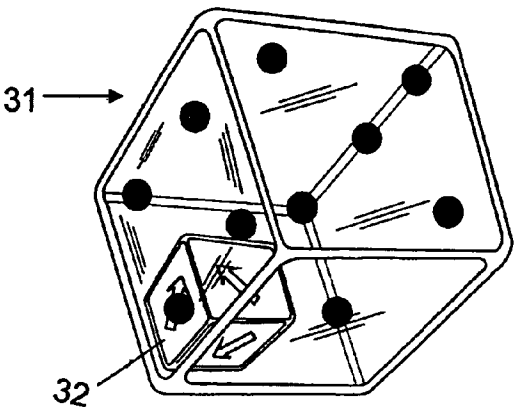
FIG. 3 is a bottom, elevational view of the invention.

FIG. 3 is a bottom view of the invention showing, again, the clear outer die (31) enclosing a smaller, inner die (32).

Figure 4:
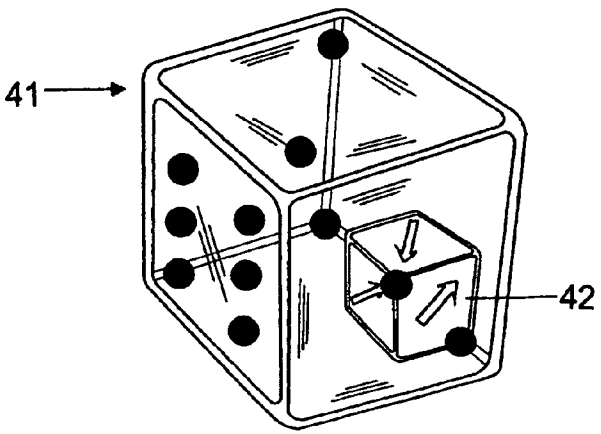
FIG. 4 is a left side, elevational view of the invention.

FIG. 4 is another view of the same iteration of the invention, showing the clear outer die (41) enclosing the smaller, inner die (42).

Figure 5:
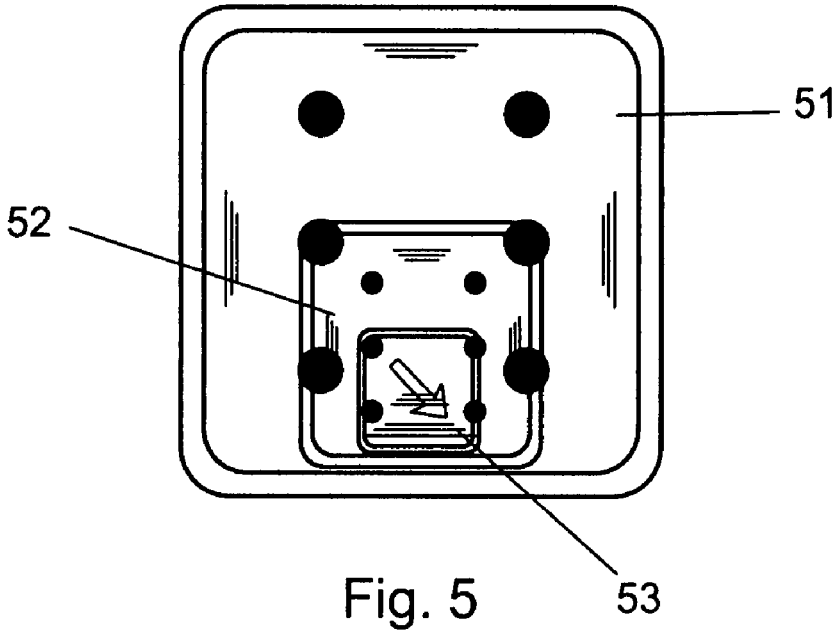
FIG. 5 is a front view of the invention showing the innermost die enclosed in the middle die, which in turn is enclosed in the outermost die.

FIG. 5 is a front view of the invention showing an innermost die (53) enclosed in a middle die (52), which in turn is enclosed in the outer die (51). The outer die (51) is clear, so that the middle die (52) and innermost die (53) can be seen. The middle die (52) is also clear, so that the innermost die (53) can be seen. When the user rolls the outer die (51), the innermost die (53) tumbles inside of the middle die (52) while the middle die (52) tumbles inside of the outer die (51). The outer die (51) and the middle die (52) are both shown in this iteration of the invention with the standard 1-6 dotted surface, while the innermost die (53) has directional arrows.

Figure 6:
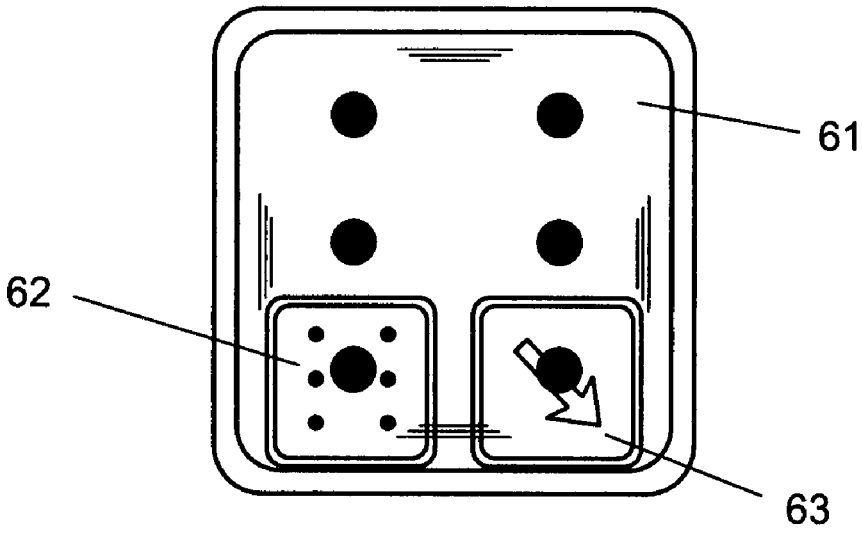
FIG. 6 is a front view of the invention showing two inner die enclosed in the outer die.

FIG. 6 is a front view of the invention showing two inner die enclosed in the outer die (61). The outer die (61) is clear, so that the two inner die can be seen. In this iteration of the invention, the outer die (61) are shown with the standard 1-6 dotted surface. One of the inner die is an inner die with the standard 1-6 dotted surface (62). The other inner die is an inner die with directional arrows on the surface (63). When the user rolls the outer die (61), the inner die with the standard 1-6 dotted surface (62) and the inner die with the directional arrows on the surface (63) each tumble independently of the other, but may come in contact with each other, while both remain enclosed in the outer die (61).

What I claim is:

1. A device for playing a game using three dice, comprising:

an outer die, and two inner dice, where the outer die is manufactured from a clear material, such as plastic, such that a user of the invention can see the two inner dice through the outer die, and where the two inner dice are enclosed within the outer die, and where the two inner dice roll and rotate independently of the outer die, the two inner dice are independent of each other, one of the two inner dice, called an innermost die, is contained within the other inner die, referred to as a middle die, the innermost die is separated from the outer die by the middle die, such that the innermost die does not touch the outer die;

all three dice have on their faces one of the following indicia: 1) standard numerals one through six, 2) directional arrows, 3) a combination of standard numerals one through six and directional arrows.

2. A method of playing a game of chance involving three dice, comprising the use of:

an outer die, and two inner dice, where the outer die is manufactured from a clear material, such as plastic, such that a user of the invention can see the two inner dice through the outer die, and where the two inner dice are enclosed within the outer die, and where the two inner dice roll and rotate independently of the outer die the two inner dice are independent of each other, one of the two inner dice, called an innermost die, is contained within the other inner die, referred to as a middle die, the innermost die is separated from the outer die by the middle die, such that the innermost die does not touch the outer die;

all three dice have on their faces one of the following indicia: 1) standard numerals one through six, 2) directional arrows, 3) a combination of standard numerals one through six and directional arrows.

* * * * *